US005836789A

United States Patent [19]

Kourimsky et al.

[11] Patent Number: 5,836,789

[45] Date of Patent: Nov. 17, 1998

[54] MULTI PORT ELECTRICAL DEVICE AND HARNESS THEREFOR

[75] Inventors: Fritz Josef Alois Kourimsky, Bensheim; Michael Karl Albin Wenzel, Alzenau, both of Germany

[73] Assignee: The Whitaker Corporation, Wilmington, Del.

[21] Appl. No.: 695,732

[22] Filed: Aug. 12, 1996

[30] Foreign Application Priority Data

Aug. 15, 1995 [GB] United Kingdom ..... 9516722

[51] Int. Cl.[6] ..... H01R 13/58

[52] U.S. Cl. ..... 439/604; 439/587

[58] Field of Search ..... 439/604, 606, 439/736, 936, 587, 589, 76.1, 492, 493, 498, 499

[56] References Cited

U.S. PATENT DOCUMENTS

| | | | |
|---|---|---|---|
| 4,596,428 | 6/1986 | Tengler | 439/606 |
| 4,725,243 | 2/1988 | Pretchel et al. | 439/606 |
| 4,798,544 | 1/1989 | Hartman | 439/606 |

*Primary Examiner*—Gary F. Paumen
*Attorney, Agent, or Firm*—Driscoll A. Nina

[57] ABSTRACT

An electrical harness for a device having a housing with multiple access ports that provide cable access to an electrical device therein, where the device has at least two connection points, the harness comprising at least two cables having one end of each terminated with a connector that is complementary to a respective one of the connection points on the electrical device characterized in that the cables are encapsulated within a seal member in their relative positions with respect to the points and seal member may be seated within the housing such that the respective connectors and connection points correspond.

9 Claims, 5 Drawing Sheets

MULTI PORT ELECTRICAL DEVICE AND HARNESS THEREFOR

BACKGROUND OF THE INVENTION

1. Field of the Invention

This invention relates to an electrical device wherein multiple cables must be interconnected therewith by way of a harness and, in particular, for reliably positioning the cables of the harness within the device.

2. Description of the Prior Art

There are many applications where it is necessary to incorporate, at a certain location, a black box or intelligence centre as part of a given apparatus where the black box receives communications from various sensors about the apparatus, analyzes that information and then distributes commands in order to regulate the apparatus. One example is in a modern vehicle where a black box typically controls such things as fuel-air mixture, ignition timing, etc. all of which are important to producing efficient engine operation. Typically, these sensors are dispersed throughout the vehicle. They all must be brought into communication with the electronic circuitry within the box. As the box is typically located where it is exposed to contaminants, it is necessary to provide sealing about the box to assure that the contamination does not enter the housing and thereby negatively effect the operation thereof. As more and more sensors are used, a greater number of inputs into the box and outputs from the box are required. Also, as the control circuitry is typically disposed upon a printed circuit board it is necessary that the cables entering the box be terminated in a connector that is matable with conventional printed circuit board features, such as plated through holes. Finally, as the printed circuit board is normally fabricated in one location and the wire harnesses are fabricated in another, it would be advantageous to provide a way of positioning the connectors on the ends of the cables in a way that would assure proper alignment with the electrical interface upon the printed circuit board while reducing the number of interconnection and assembly steps required.

SUMMARY OF THE INVENTION

These objects are met by the invention by providing an electrical harness for a device having a housing with multiple access ports that provide cable access to an electrical device therein, where the device has at least two connection ports, the harness comprising at least two cables having one end of each terminated with a connector that is complementary to a respective one of the connection points on the electrical device characterized in that the cables are encapsulated within a seal member in their relative positions with respect to the ports and seal member is seated within the housing such that the respective connectors and connection points correspond.

It is an advantage of this invention that a single wire harness package is produced having multiple cables extending therefrom. It is another advantage of this invention that the electrical harness may be produced separately from the device and assembled therewith by properly positioning the seal therein. It is still another advantage of this invention that by properly positioning the seal the connectors, upon the cables are properly positioned relative to their connection points. It is still yet another advantage of this invention that by encapsulating the cables within the seal member and seating the seal member within the housing of the device, a sealed package may be produced that prevents contamination from reaching the interior where the electrical device is disposed. It is still a further advantage that by positioning the cables within a seal structure the seal structure is pliable enough to accommodate variations in the locations of the connection points.

BRIEF DESCRIPTION OF THE DRAWINGS

FIG. 8 is a side sectional view of an electrical device incorporating the harness of FIG. 1 therein.

DETAILED DESCRIPTION OF THE PREFERRED EMBODIMENT

Figure 1:
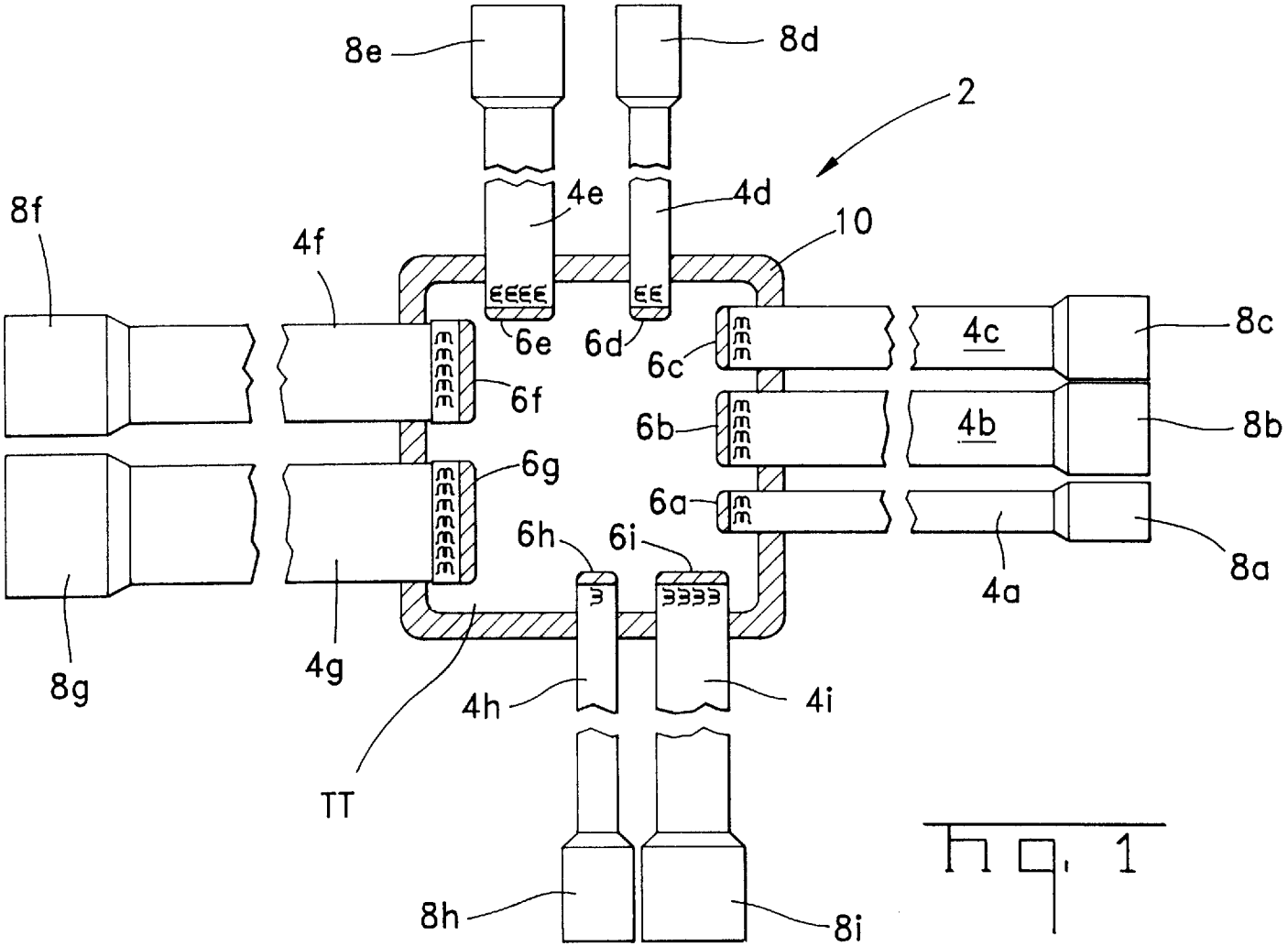
FIG. 1 is a top partially cutaway view of an electrical harness according to the present invention.

With reference now to FIG. 1, an electrical harness according to the present invention is shown generally at 2. The electrical harness 2 includes a number of cables 4*a–i* that, in this embodiment, are ribbon cables having a numerical-variety of conductors therein. While in this embodiment the conductors vary between 1–7 within the various cables and a total of 9 cables are shown; other cables having more or less conductors may be used and a harness incorporating a greater or lesser number of cables may also be used. Disposed at the end of each cable is a interior electrical connector 6*a–i* for terminating the electrical cables 4*a–i*. At the opposite end of the cables 4*a–i* are corresponding exterior connectors 8*a–i*. The cables 4 and their associated connector 6,8 are positioned relative to their desired interconnection locations and a seal member 10 is formed thereabout that encapsulates the cables 4 near the interior connectors 6 such that the interior connectors 6 are generally positioned relative to the desired location of their interconnection points. The interior connectors 6 are further positioned within the inner area 11 of the seal 10. In this embodiment, the seal 10 is advantageously overmoulded about the cables and is formed of typical material that is well known and suitable for applications within automotive engine compartments where the seal has some resiliency thereto.

Figure 2:
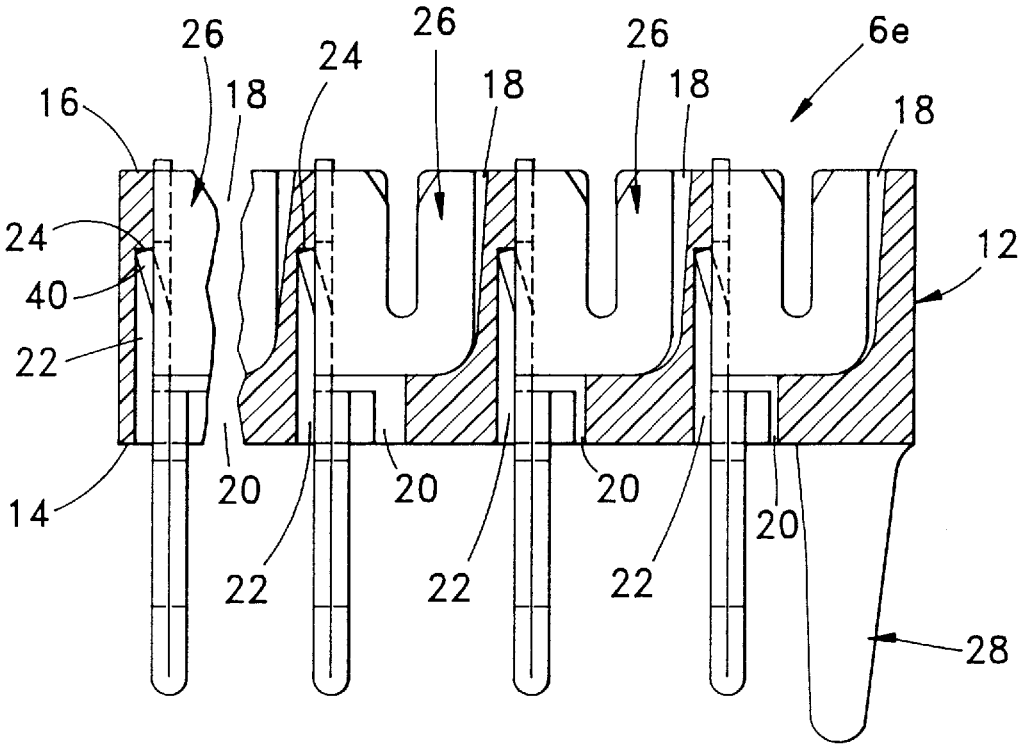
FIG. 2 is a side sectional view of an electrical connector that may be incorporated into the harness of FIG. 1.
Figure 3:
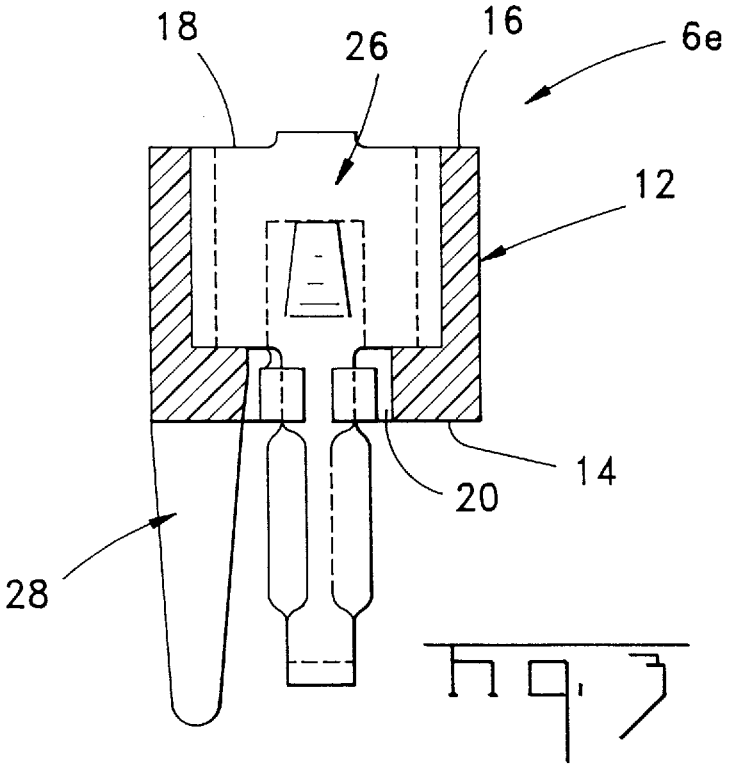
FIG. 3 is an end section view of the electrical connector of FIG. 2.

With respect to FIG. 2 and FIG. 3, the interior electrical connector 6 is illustrated. The electrical connector 6 includes a connector housing 12 having a base 14 and an upper surface 16 with a plurality of contact receiving bays 18 therein. Each receiving bay 18 is opened from the upper face 16 through the base 14 by way of a channel 20. An auxiliary channel 22 is disposed along each of the bays 18 and includes a shoulder 24 for contact retention as will be described below. Located within each of the bays 18 is an electrical contact 26 that is more fully described below. Extending outward from the base 14 is a positioning pin 28 that is in registration with each of the bays 18 and channels 20 such that the contacts 26 loaded therein are reliably positioned with reference thereto. Therefore, by properly positioning the positioning 28, the whole connector 6 may be reliably positioned and the contacts may be properly disposed in their desired orientation. While the afore mentioned connector is shown for the cable having a four conductor core, such as 4*e*, it would be obvious to increase or decrease the number of contact bays as required in order to have more or less contacts therein.

Figure 4:
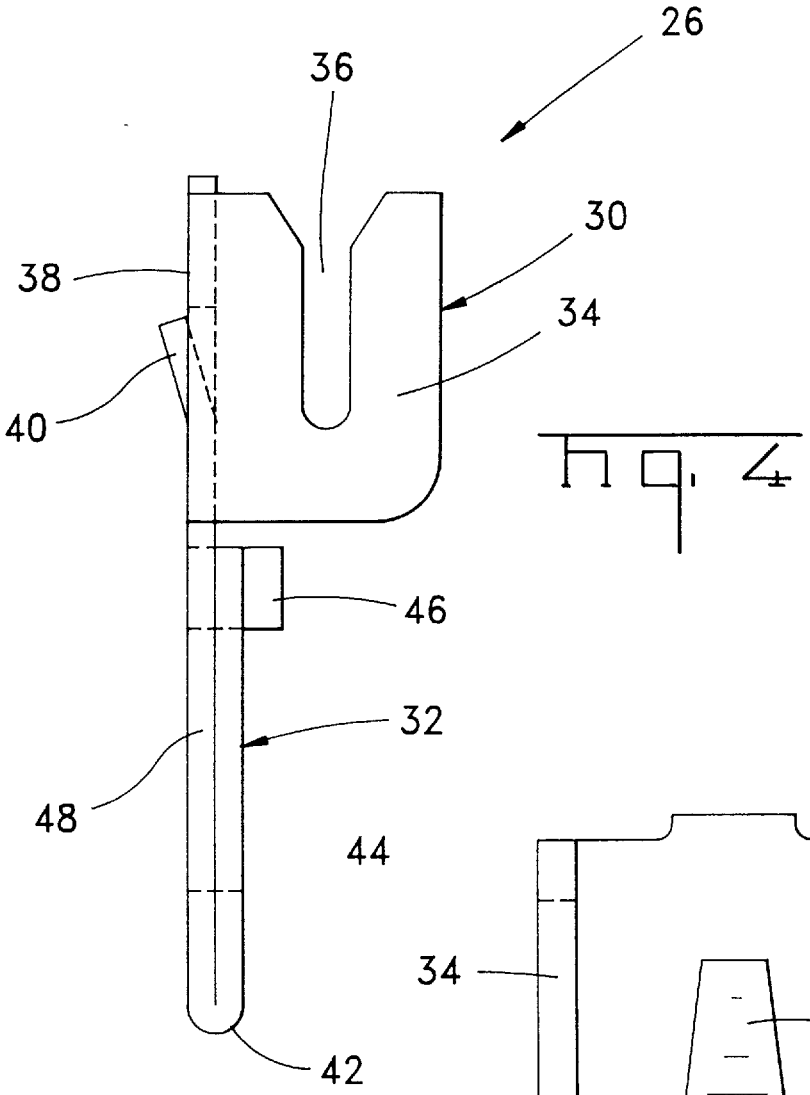
FIG. 4 is a side view of an electrical contact used within the connector of FIG. 2.
Figure 5:
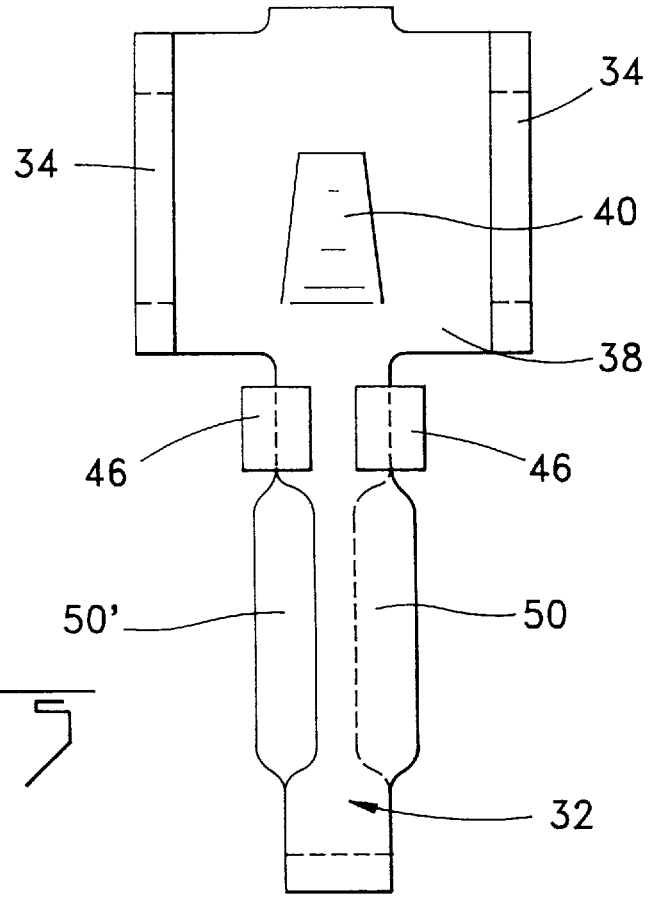
FIG. 5 is a rear view of the electrical contact of FIG. 4.

With reference now to FIG. 4 and FIG. 5, the contact 26 will be described in greater detail. The contact 26 includes an upper insulation displacement contact (IDC) portion 30 and a lower through hole pin portion 32. The upper IDC portion 30 includes spaced apart plates 34 having an IDC slot 36 therein that are joined together by a back wall 38. The back wall 38 carries a locking lance 30 struck outward therefrom such that it would abut the shoulder 24 of the connector housing 12 as shown in FIG. 2 to retain the contact 26 in the housing 12. The pin portion 32 includes an overlapped section of material formed through a bend 42 thereof, whereby the thickness of the pin portion 32 is now double the thickness of the material from which the contact 26 is formed. The overlapping portion 44 includes a pair of tabs 46 clinched about the main portion 48. The main portion 48 and the overlapping portion 44 each include oppositely meandering sections 50,50' so that the width of the pin section 32 is provided with some resilience and compliance.

Figure 6:
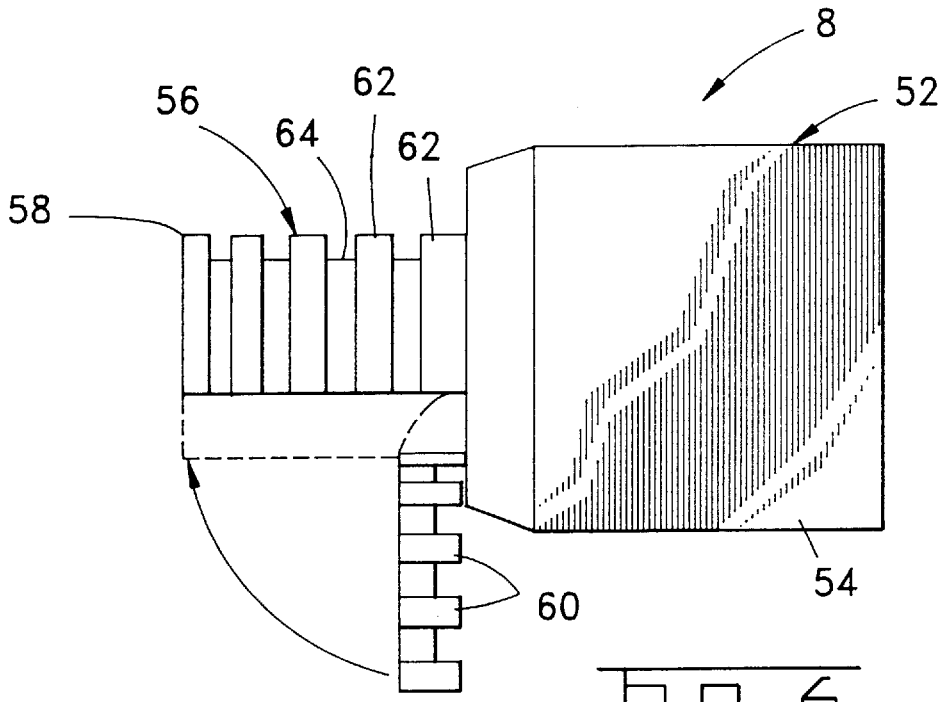
FIG. 6 is a side view of a connector housing that may be incorporated onto the end of the cables of the harness of FIG. 1.
Figure 7:
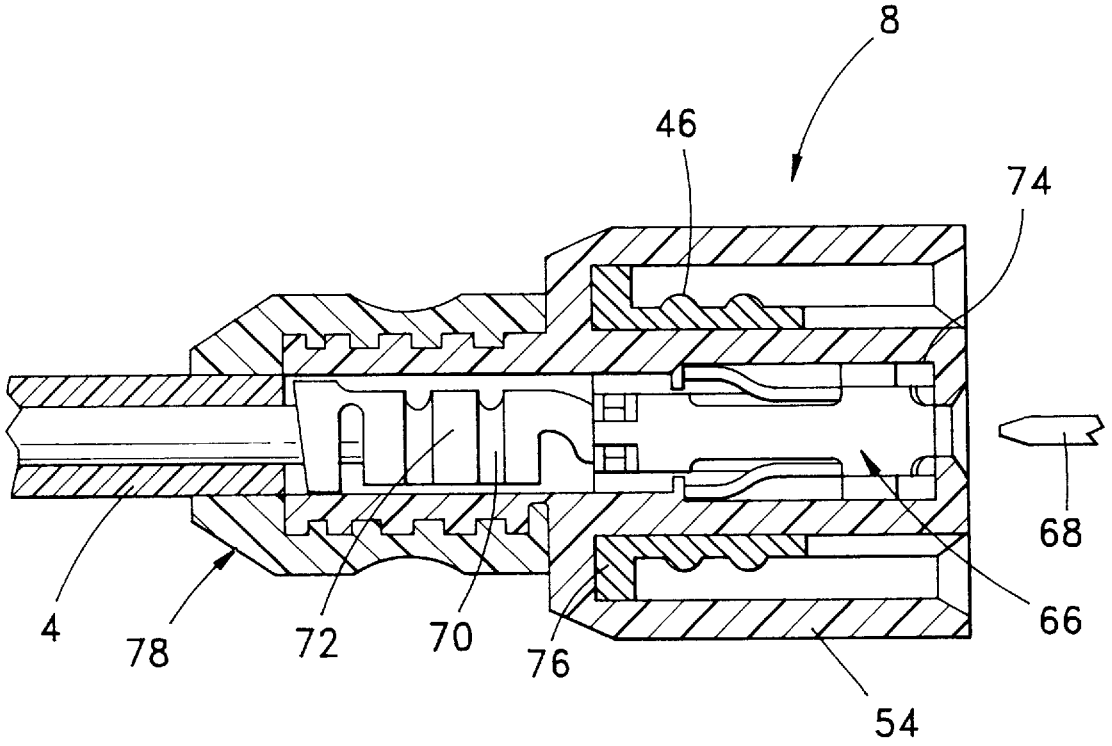
FIG. 7 is a side sectional view of a complete connector of FIG. 6.
Figure 1:
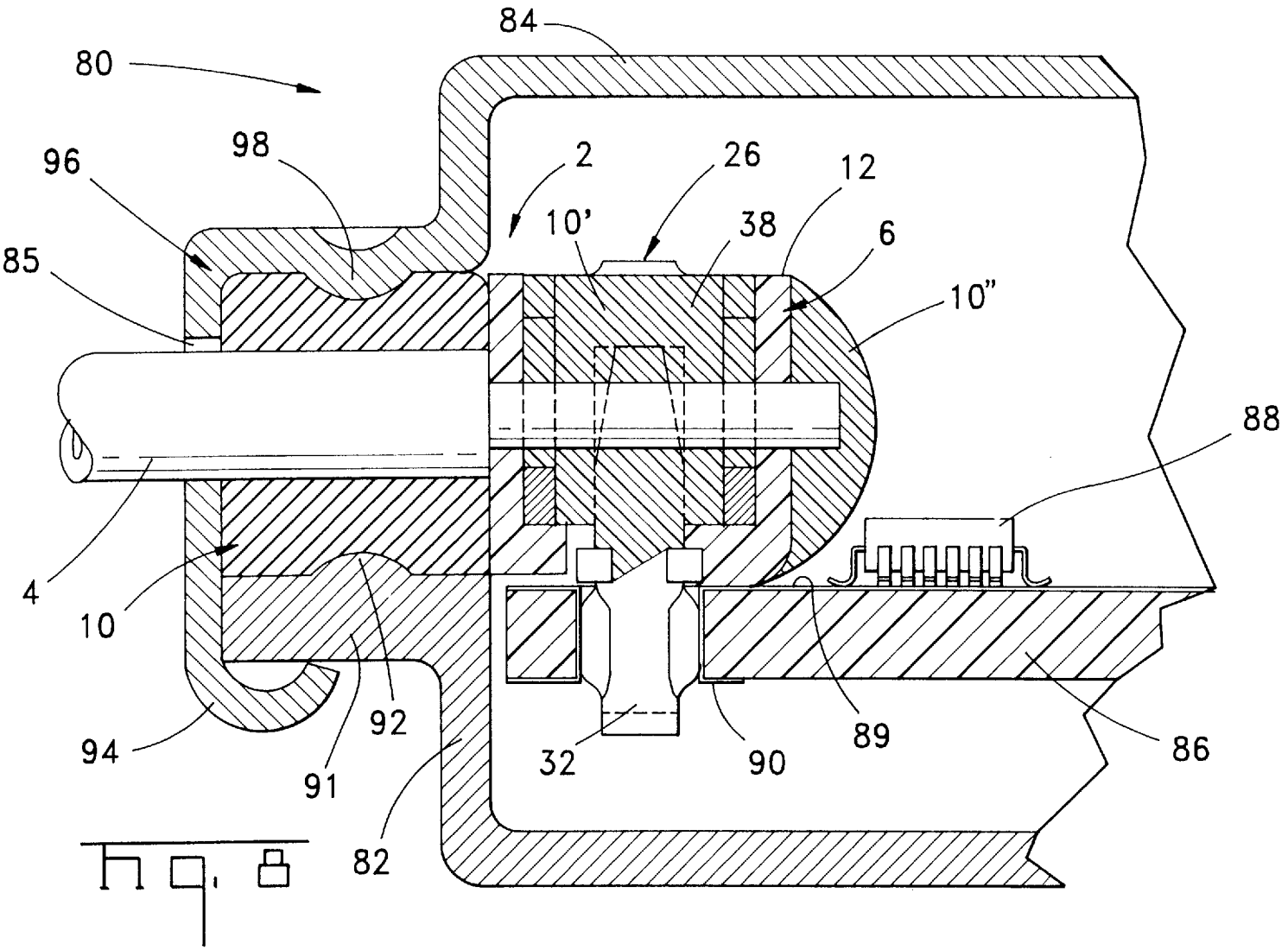

With reference now to FIG. 6 and FIG. 7, the electrical connector 8 at the exterior end of the cables 4 is shown. The connector 8 includes an outer housing 52 having a shroud 54 and a wire entry portion 56 including a base portion 58 and a flap 60. With a plurality of ridges 62 formed therealong that define grooves 64 therebetween. With reference in particular to FIG. 7, the connector 8 is shown terminated upon the cable 4 with a contact 66 for mating with a complementary terminal, the contact 66 is joined to the conductors 70 of the cable 4 by a crimp barrel 72 although other termination techniques may be used. The connector housing 8 includes a terminal block portion 74 wherein these receptacle contacts 66 are disposed and the terminal block 74 carries a seal member 76 in order to form a sealing tight fit with a mating connector that carries the complementary terminal 68. Once the contact 66 is properly positioned within the connector 8, boot 78 may be overmoulded that seals the rear portion 56 and the cable 4 so that contamination is prevented, so that a contaminant-proof connection is established.

With reference now to FIG. 8, an electrical device incorporating the present invention is shown generally at 80. The electrical device 80 includes a lower housing 82 and an upper housing 84 with access parts 85 therethrough. A printed circuit board 86 is disposed within the housing 82,84 having a plurality of integrated circuit components 88 mounted thereto. The printed circuit board 86 includes a plurality of plated through holes 90 that are connected by circuit traces 89 to components 88 for establishing electrical connection with the cables 4. While plated through-holes 90 are shown in this embodiment, other styles of connection points common to printed circuit board may be used and the mating connector may be so adapted to be complementary thereto. As shown, the wire harness 2 is set upon the lower housing 82 such that the seal 10 corresponds to a flange 91 having a positioning bump 92 thereupon. Although not shown, the positioning pin 28 of the housing 12 of the connector 6 is received within a corresponding hole in the printed circuit board 86 in order to assure that the contact tails 32 are aligned with their respective through-holes 90 during mating. It may be desirable to fully overmould the connector housing 6 with sealed material after the cables 4 have been terminated therein whereby seal material 10' is received within the contact bays 18 and about the contacts 26 and extend over the ends of the cables by an amount 10" whereby the connector is fully sealed to the cable. When the upper housing half 84 is mounted to the lower housing 82, a hook 94 engages the flange 91 of the lower housing half 82 fully trapping the seal 10 between the flange 91 of the lower half 92. The flange 96 also includes a positioning bump 98 thereupon such that the seal 10 is captivated therebetween in a compressive manner to form a tight seal with the housing halves 82,84.

It is important to note that the resiliency of the seal member allows some limited displacement of the connector 6 to ensure that proper positioning relative to the printed circuit board occurs due to the tolerance in differences between the overmoulding operation and the printed circuit board forming operations. Advantageously, the seal provides the necessary sealing for the connector housing and also the positioning necessary to assure proper handling and advantageous assembly of the device.

We claim:

1. An electrical harness for a device having a housing with multiple access ports that provide cable access to an electrical device therein, where the device has at least two connection points, the harness comprising at least two cables having one end of each terminated with a connector that is complementary to a respective one of the connection points on the electrical device characterized in that the cables are encapsulated within a seal member in their relative positions with respect to the connection points and the seal member is to be seated within the housing such that the respective connectors and connection points then correspond.

2. The harness of claim 1 further characterized in that each connector is be mated with the connection point is fully overmoulded by the seal member after the cable is terminated therein.

3. The harness of claim 2 further characterized in that each connector is includes IDC contacts having spaced apart plates with aligned IDC slots therein where the plates are joined together by a back wall having a locking lance therein and opposite the IDC slots is a pin portion for electrically engaging a printed circuit board.

4. The harness of claim 1 further characterized in that the seal member and the housing include complementary positioning features for locating the seal member.

5. The electrical harness of claim 1 further characterized in that the seal member defines a closed inner area wherein the inner connectors are disposed.

6. An electrical device comprising a lower housing, an upper housing, a substrate therein having a plurality of connection points thereupon and a wire harness having a plurality of cables with respective connectors attached thereto that are complementary to the connection points, the cables being encapsulated within a seal member whereby the connectors are positioned to correspond to the connection points and the seal member is receivable between the upper and lower housings to form a contaminate-proof structure with the cables extending therefrom.

7. The electrical device of claim 6 further characterized in that the lower housing includes a positioning feature for locating the seal member.

8. The electrical device of claim 6 further characterized in that contacts within the connectors terminate the corresponding cables by way of IDC techniques.

9. The electrical device of claim 6 further characterized in that the seal member defines a closed inner area in which the inner connectors are disposed.

* * * * *